US007990406B2

(12) United States Patent
Yoshimaru

(10) Patent No.: US 7,990,406 B2
(45) Date of Patent: Aug. 2, 2011

(54) OPTICAL SCANNING DEVICE HAVING A PITCH ADJUSTMENT DEVICE FOR ADJUSTING A BEAM PITCH AND IMAGE FORMING APPARATUS INCLUDING SAME

(75) Inventor: Akito Yoshimaru, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 12/389,936

(22) Filed: Feb. 20, 2009

(65) Prior Publication Data

US 2009/0225146 A1 Sep. 10, 2009

(30) Foreign Application Priority Data

Mar. 4, 2008 (JP) ..... 2008-053294

(51) Int. Cl.
*B41J 2/435* (2006.01)
*B41J 2/47* (2006.01)

(52) U.S. Cl. ..... 347/234; 347/248

(58) Field of Classification Search ..... 347/233, 347/234, 241–244, 229, 248, 249
See application file for complete search history.

(56) References Cited

U.S. PATENT DOCUMENTS

| | | | | |
|---|---|---|---|---|
| 5,786,594 | A * | 7/1998 | Ito et al. | 250/236 |
| 5,999,345 | A * | 12/1999 | Nakajima et al. | 359/821 |
| 6,288,818 | B1 | 9/2001 | Yoshimaru et al. | |
| 7,593,028 | B2 * | 9/2009 | Kimura | 347/234 |

FOREIGN PATENT DOCUMENTS

| | | |
|---|---|---|
| JP | 09-226174 | 9/1997 |
| JP | 2001-004941 | 1/2001 |
| JP | 2001-024269 | 1/2001 |
| JP | 2001-091870 | 4/2001 |
| JP | 2001-74731 | 6/2001 |
| JP | 2001-242403 | 9/2001 |
| JP | 2003-131153 | 5/2003 |
| JP | 3437025 | 6/2003 |
| JP | 2003-315710 | 11/2003 |
| JP | 2004-045840 | 2/2004 |
| JP | 2004-246329 | 9/2004 |
| JP | 2004-333559 | 11/2004 |
| JP | 2005-305950 | 11/2005 |
| JP | 2005-338575 | 12/2005 |

* cited by examiner

*Primary Examiner* — Hai C Pham
(74) *Attorney, Agent, or Firm* — Dickstein Shapiro LLP

(57) ABSTRACT

A multi-beam scanning device for focusing deflected light beams onto an object to be scanned includes a light source unit, a deflector, a pitch adjustment device, and a conical-shape compression-torsion coil spring. The light source unit is rotatable about an optical axis and includes a plurality of light sources to emit the light beams and a plurality of coupling lenses disposed corresponding to the light sources. The deflector deflects the light beams emitted from the plurality of the light sources and passed through the plurality of the coupling lenses. The pitch adjustment device moves the light source unit in a first direction around the optical axis to adjust a beam pitch. The conical-shape compression-torsion coil spring urges the light source unit in a second direction opposite the first direction around the optical axis as well as in the optical axis direction. An image forming apparatus includes the multi-beam scanning device.

8 Claims, 10 Drawing Sheets

"PITCH FIXING MODE"

"PITCH FIXING MODE"

"HP CHANGE MODE"

OPTICAL SCANNING DEVICE HAVING A PITCH ADJUSTMENT DEVICE FOR ADJUSTING A BEAM PITCH AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2008-053294 filed on Mar. 4, 2008 in the Japan Patent Office, the entire contents of which are hereby incorporated herein by reference.

BACKGROUND OF THE INVENTION

1. Field of the Invention

Exemplary aspects of the present invention generally relate to an optical scanning device, and more particularly, to a multi-beam scanning device using multiple light beams and an image forming apparatus that includes the multi-beam scanning device.

2. Description of the Background Art

Conventionally, there is known a single-beam optical scanning device employed in, but not limited to, an image forming apparatus, such as a digital copier and a laser printer. In order to increase recording speed of such single-beam optical scanning device, a rotation speed of a deflector, for example, a polygon mirror, is increased.

However, there is a drawback to this approach in that stress on a motor that drives the polygon mirror increases, thereby degrading its durability and generating noise and vibrations. Thus, there is a certain limit to the rotation speed of the polygon mirror.

In view of the above, multi-beam scanning devices that simultaneously emit a plurality of light beams so as to be able to simultaneously record multiple lines of an image, text, etc. have been proposed.

In such multi-beam scanning devices, since a plurality of light beams is emitted, it is necessary to properly adjust beam pitches in a sub-scan direction on a scanned surface so as to achieve a desired writing density or pixel density.

In order to achieve the desired writing density, the configuration of a device for adjusting the beam pitch of the related-art multi-beam scanning devices tends to be complicated, thereby increasing the size of the device and thus defeating the purpose of reducing the size of the image forming apparatus as a whole.

When the beam pitch is not properly adjusted, a desired image cannot be produced, resulting in performance failure of the image forming apparatus and reducing productivity.

SUMMARY OF THE INVENTION

In view of the foregoing, in one illustrative embodiment of the present invention, a multi-beam scanning device for focusing deflected light beams onto an object to be scanned includes a light source unit, a deflector, a pitch adjustment device, and a conical-shape compression-torsion coil spring. The light source unit is rotatable about an optical axis and includes a plurality of light sources to emit a plurality of light beams and a plurality of coupling lenses disposed corresponding to the light sources. The deflector is configured to deflect the light beams irradiated from the plurality of the light sources and passed through the plurality of the coupling lenses. The pitch adjustment device is configured to move the light source unit in a first direction around the optical axis to adjust a beam pitch. The conical-shape compression-torsion coil spring is configured to urge the light source unit in a second direction opposite the first direction around the optical axis as well as in the optical axis direction.

According to one preferred embodiment of the present invention, an image forming apparatus for forming an image includes an image bearing member, a charging device, a developing device, a transfer device, a fixing device, and the multi-beam scanning device. The image bearing member is configured to bear an electrostatic latent image on a surface thereof. The charging device is configured to charge the surface of the image bearing member. The developing device is configured to develop the electrostatic latent image formed on the image bearing member using toner to form a toner image. The transfer device is configured to transfer the toner image onto a recording medium. The fixing device is configured to fix the toner image onto the recording medium.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
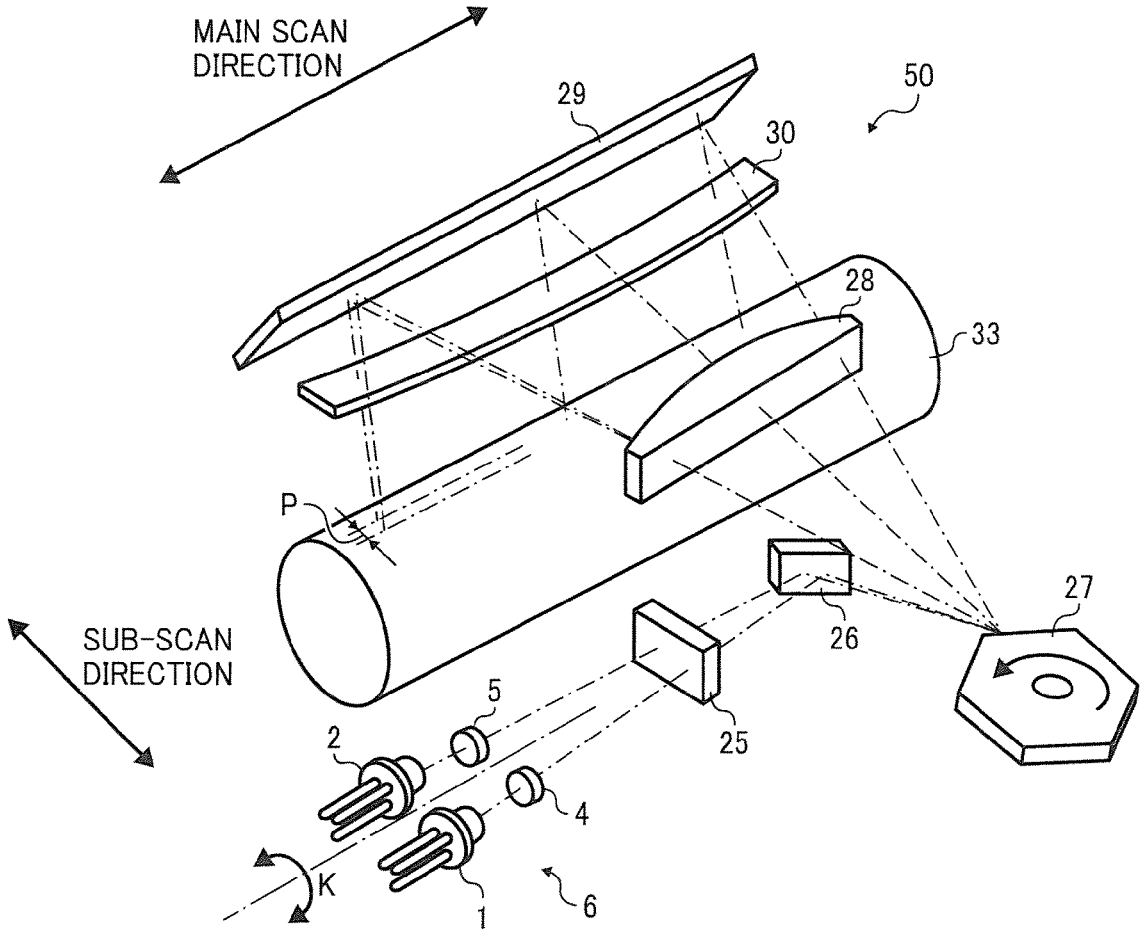
FIG. 1 is a schematic diagram illustrating an example of a light source unit and a photoreceptor drum as an object to be scanned according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, a multi-beam scanning device as one example of an optical scanning device according to an illustrative embodiment of the present invention is described.

FIG. 1 is a schematic diagram illustrating a multi-beam scanning device and a photoreceptor drum serving as an image bearing member as an example of an object to be scanned by the multi-beam scanning device.

As illustrated in FIG. 1, the multi-beam scanning device includes a light source unit 6, a cylindrical lens 25, a mirror 26, a polygon mirror 27, an f-θ lens 28, a mirror 29, a toroidal lens 30, and so forth.

The light source unit 6 includes semiconductor lasers 1 and 2, coupling lenses 4 and 5, and so forth. The semiconductor lasers 1 and 2 emit light beams. The light beams emitted from the semiconductor lasers 1 and 2 pass through the coupling lenses 4 and 5 as well as the cylindrical lens 25.

Subsequently, the light beams reach the mirror 26 and then are reflected by the polygon mirror 27.

Each of the light beams passes through the f-θ lens 28 and is reflected by the mirror 29. Subsequently, each of the light beams passes through the toroidal lens 30 so as to scan the surface of the photoreceptor drum 33.

The light beams emitted from the semiconductor lasers 1 and 2 scan the photoreceptor drum 33 so as to optically write on the photoreceptor drum in a main scan direction at a certain beam pitch, in this case, at a beam pitch P in the sub-scan direction. Subsequently, a beam pitch adjustment mechanism, described later, turns the light source unit 6 about an optical axis in directions indicated by arrow K so that the beam pitch P can be adjusted.

Figure 2:
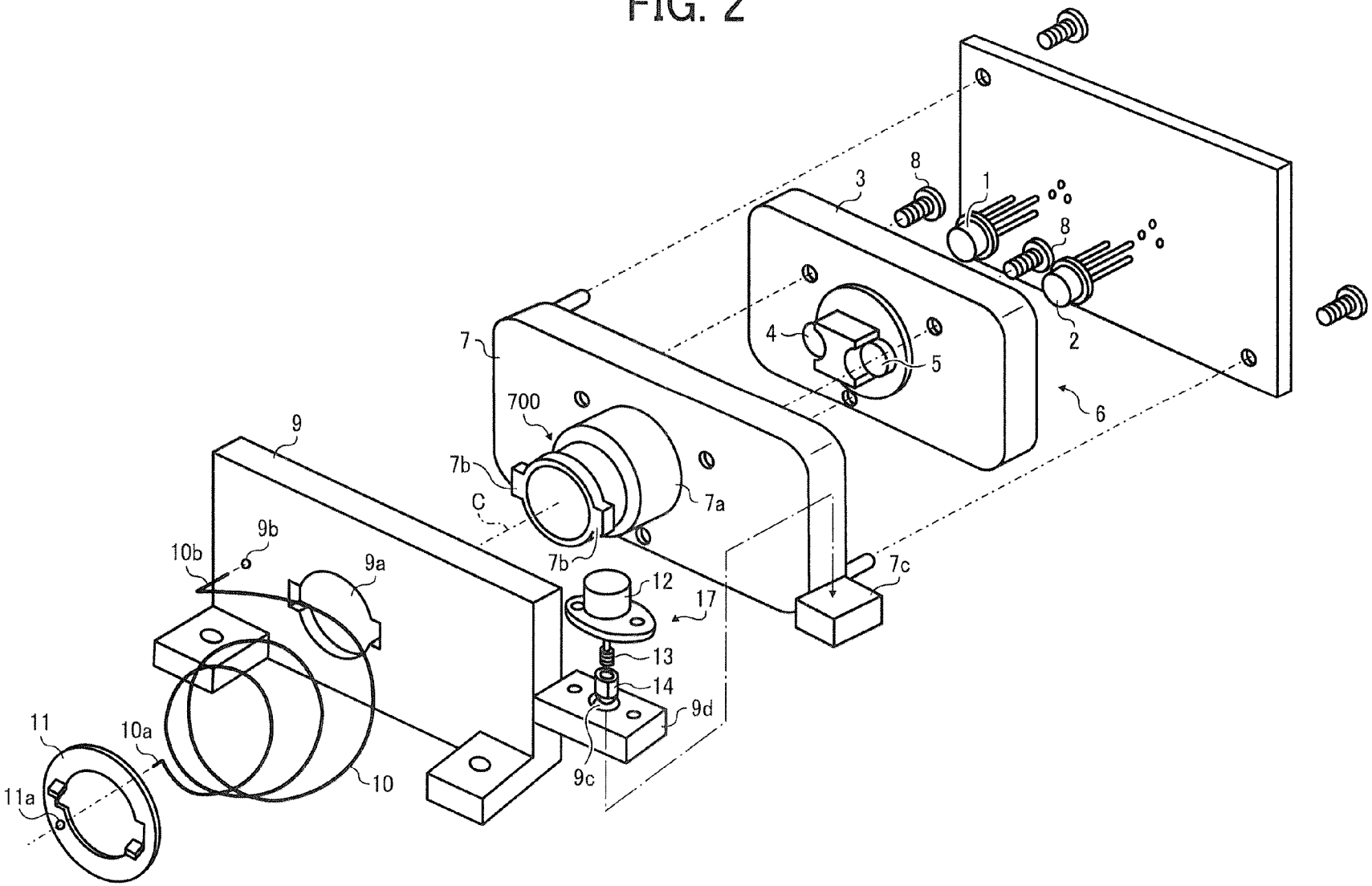
FIG. 2 is an exploded perspective view illustrating the light source unit of FIG. 1 and a beam pitch adjustment mechanism according to an illustrative embodiment of the present invention.
Figure 3:
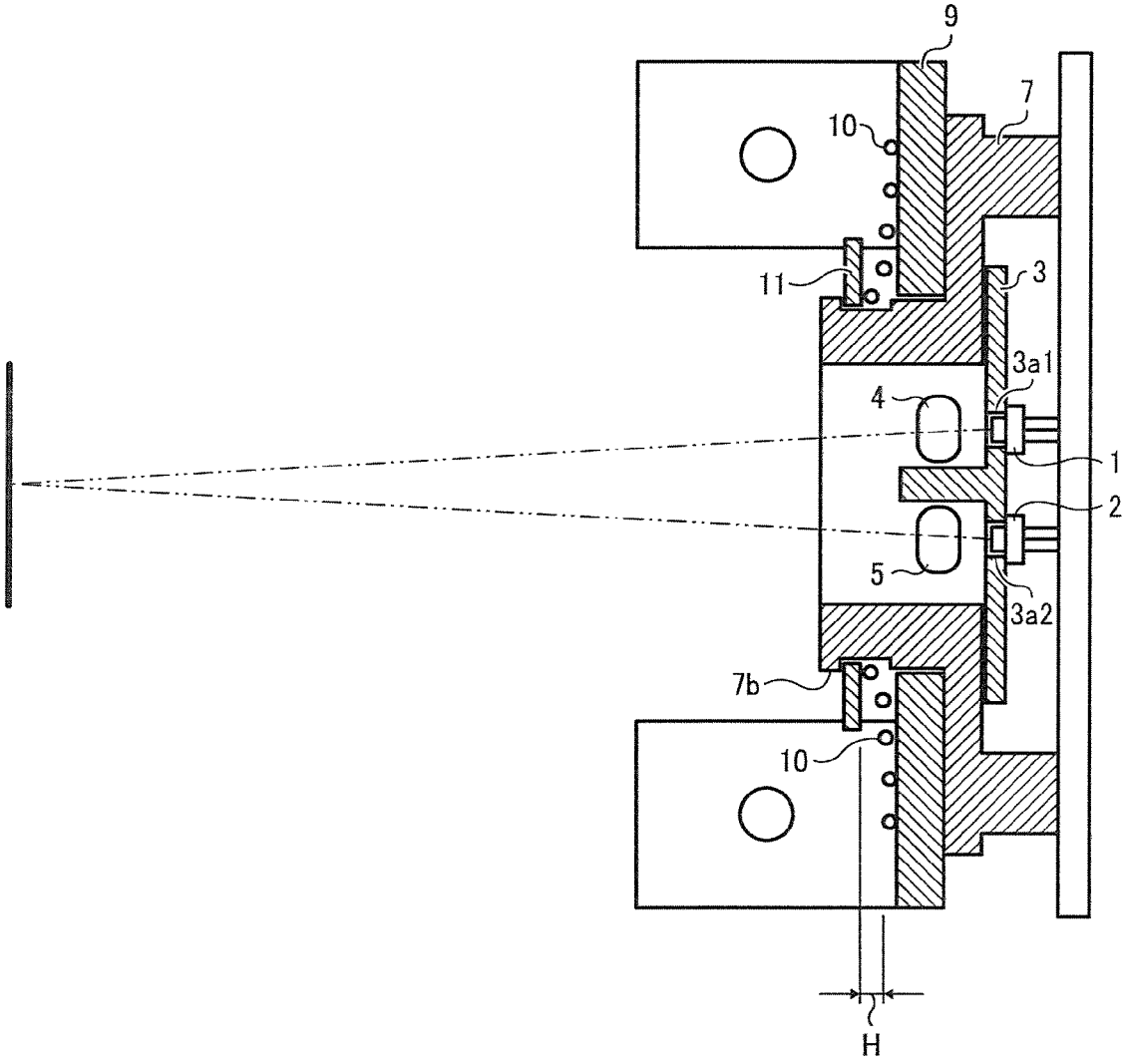
FIG. 3 is a cross-sectional view of FIG. 2 according to an illustrative embodiment of the present invention.

With reference to FIGS. 2 and 3, a description is provided of the light source unit 6 and the beam pitch adjustment mechanism. FIG. 2 is an exploded perspective view of the light source unit 6 and the beam pitch adjustment mechanism. FIG. 3 is a cross-sectional view of FIG. 2 in the main scan direction.

As illustrated in FIG. 2, the two semiconductor lasers 1 and 2 are disposed next to each other in the main scan direction substantially at the back of a base member 3 that is the equivalent of the right side in FIG. 3.

As illustrated in FIG. 3, the base member 3 includes mounting holes 3*a*1 and 3*a*2. The semiconductor lasers 1 and 2 are pressed into and secured by the holes 3*a*1 and 3*a*2, respectively.

The coupling lenses 4 and 5 are fixed to the base member 3, such that the light beams emitted from the semiconductor lasers 1 and 2 are formed into a light flux having a predetermined diffusion.

As described above, the semiconductor lasers 1 and 2, the base member 3, and the coupling lens 4 and 5 generally constitute the light source unit 6. The base member 3 is fixed to a retainer 7 by screws 8.

A cylindrical protrusion 700, a center axis of which substantially coincides with an optical axis C, is formed on the retainer 7. The cylindrical protrusion 700 includes a base portion 7*a* and flanges 7*b*. The base portion 7*a* of the cylindrical protrusion 700 is fit into a fitting hole 9*a* formed in a light source retainer 9 so as to position the retainer 7.

Furthermore, a conical-shaped compression-torsion coil spring 10 (hereinafter simply referred to as a coil spring) is wound around the cylindrical protrusion 700 that projects from the light source retainer 9 and compressed. Then, a ring-shaped stopper 11 is hooked to the flanges 7*b* formed at both sides of the tip portion of the cylindrical protrusion 700 so that pressure of the coil spring 10 urges the retainer 7 against the light source retainer 9.

This configuration constitutes a so-called urging mechanism in the optical axis direction.

The coil spring 10 includes a bent portion 10*a* and an arm portion 10*b*. The bent portion 10*a* is formed at the front tip of the coil spring 10 and fit into a hole 11*a*, while the arm portion 10*b* formed at the other end of the coil spring 10 is hooked to a hole 9*b* of the light source retainer 9 so as to generate torsional force in a counterclockwise direction.

This configuration constitutes a so-called inverse rotation urging mechanism.

The retainer 7 also includes an extended portion 7*c*. The extended portion 7*c* presses against a pressure member 14 of a pitch adjustment device 17, thereby allowing adjustment of rotation around the optical axis.

On a side surface of the light source retainer 9, a mounting portion 9*d*, on which the pitch adjustment device 17 is mounted, is provided so as to project therefrom and form a lateral extension of the light source retainer 9. The mounting portion 9*d* includes a guide hole 9*c*, through which the pressure member 14 is inserted.

As noted, the coil spring 10 according to the illustrative embodiment is a compression-torsion coil spring having a conical shape, to which compressive and torsional loads (torque) are exerted.

In particular, the torsional load is exerted around the center axis of the coil. The coil spring 10 has a conical shape, a diameter of which gradually increases from downstream to upstream in the optical axis direction. The general description of the coil spring 10 is referenced in a) a spring basic and c) spring shape of "Glossary of terms used in springs" in JIS B 0103 of the Japanese Industrial Standards.

As described above, according to the illustrative embodiment, the coil spring 10 presses the retainer 7 against the light source retainer 9. Accordingly, the coil spring 10 serves as the urging mechanism that urges in the optical axis direction.

Furthermore, the coil spring 10 produces rotational force around the optical axis. Therefore, the coil spring 10 also serves as the inverse rotation urging mechanism, that is, the urging mechanism which returns the light source unit 6 in an opposite direction as the direction in which the light source unit was turned by the pitch adjustment device 17 described later.

Figure 4:
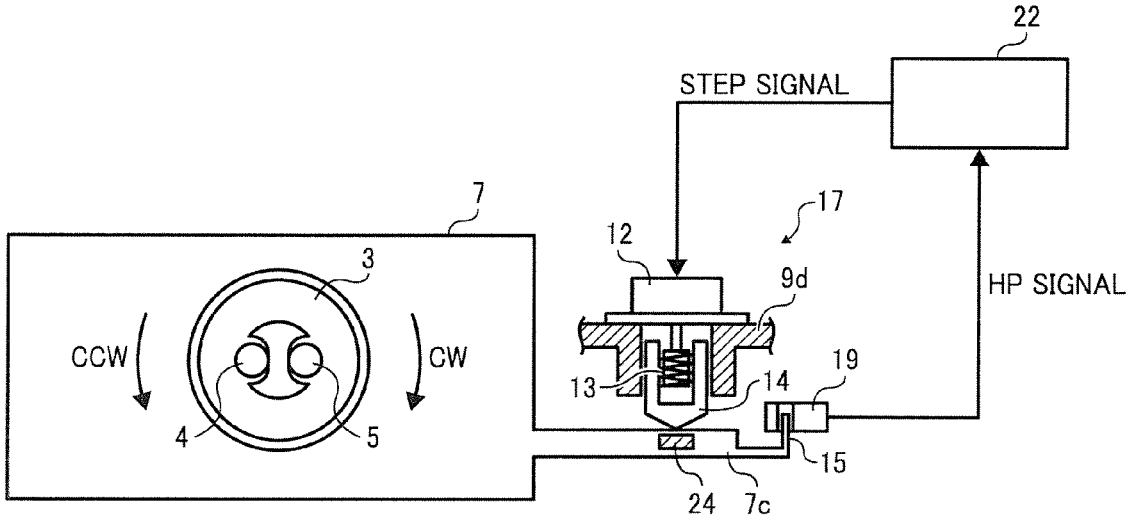
FIG. 4 is a front view illustrating a portion of the beam pitch adjustment mechanism according to an illustrative embodiment of the present invention.
Figure 5:
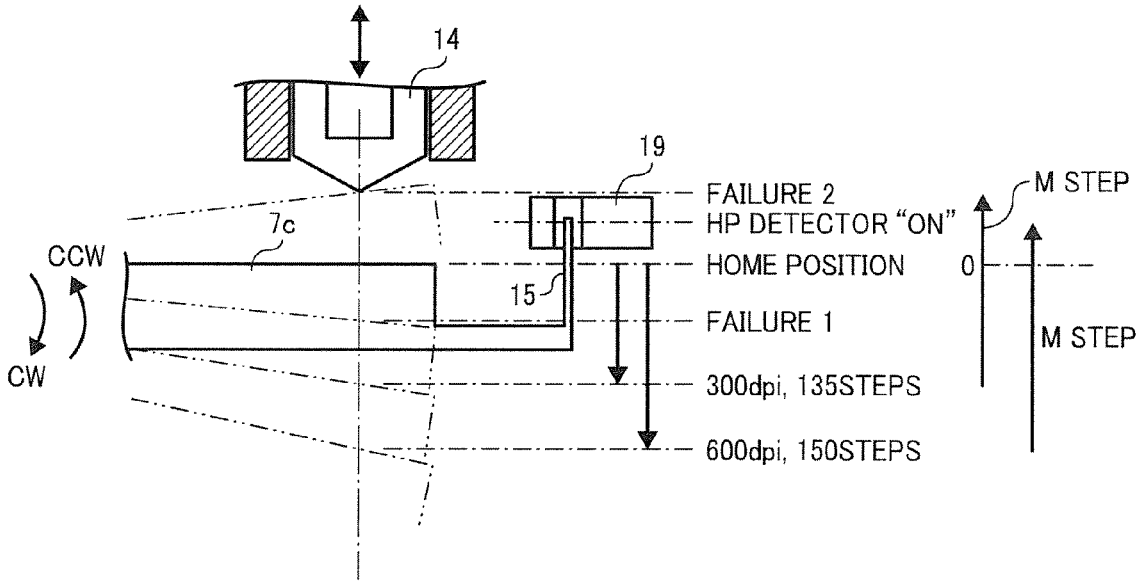
FIG. 5 is a schematic diagram illustrating a home position (HP) of the light source unit and positions corresponding to different pixel densities according to an illustrative embodiment of the present invention.

Next, with reference to FIGS. 2, 4, and 5, a description is provided of the beam pitch adjustment mechanism. FIG. 4 is a front view of the beam pitch adjustment mechanism. FIG. 5 is a schematic diagram conceptually illustrating a relative position of the home position (HP) of the light source unit 6 and different positions associated with different pixel densities.

The pitch adjustment device 17 is mounted to the mounting portion 9*d* of the light source retainer 9 and includes a stepping motor 12, a screw 13 fixed to a shaft of the stepping motor 12, and the pressure member 14 which the screw 13 engages. The stepping motor 12 serves as a driving source.

The pressure member 14 is substantially D-shaped in cross-section and inserted into the guide hole 9*c* of the mounting portion 9*d*. The guide hole 9*c*, through which the pressure member 14 is inserted, has a shape corresponding to the shape of the pressure member 14 so as to accommodate the pressure member 14.

Internal threads are provided inside the pressure member 14. As the screw 13 turns in the pressure member 14, the pressure member 14 moves up and down along the guide hole 9*c* that regulates rotation of the pressure member 14.

The tip of the pressure member 14 contacts the extended portion 7*c* of the retainer 7. The light source unit 6 is always subjected to a force exerted in the counterclockwise direction due to torsional force of the spring 10, so that, when the pressure member 14 moves downward, the light source unit 6 rotates in the clockwise (CW) direction indicated by arrow CW.

By contrast, when the pressure member 14 moves upward, the light source unit 6 rotates in the counterclockwise (CCW) direction indicated by arrow CCW.

With reference to FIG. 4 illustrating the front view of the beam pitch adjustment mechanism, a description is provided of a beam pitch error detector 22.

The beam pitch error detector 22 serves as a beam pitch controlling mechanism that controls the direction of rotation as well as an amount of rotation of the stepping motor 12, thereby controlling rotation angle of the light source unit 6, and thus enabling adjustment of the beam pitch on the surface to be scanned.

The beam pitch error detector 22 is triggered by the operation of the pitch adjustment device 17. That is, as illustrated in FIGS. 4 and 5, the pitch adjustment device 17 includes a home position detector 19 (hereinafter simply referred to as HP detector 19).

According to the present illustrative embodiment, the home position (HP) refers to a position at which a filler 15 attached to the extended portion 7*c* of the retainer 7 of the light source unit 6 cuts across the HP detector 19. It is to be noted that the home position is simply referred to as HP in drawings.

The beam pitch error detector 22 includes a memory that stores data of a number of rotations, or a number of steps from the home position, necessary for the stepping motor 12 to rotate in order to set the beam pitch to a proper beam pitch depending on different pixel densities. The beam pitch error detector 22 is configured to send the necessary number of steps or a step signal in accordance with the pixel density to be set.

According to the present illustrative embodiment, when the pixel density or a resolution is 300 dpi, the number of steps is set to 135. When the pixel density is 400 dpi, the number of steps is 140. When the pixel density is 600 dpi, the number of steps is 150. The memory of the beam pitch error detector 22 stores data of a current pixel density that is currently set.

"M steps" in FIG. 5 refers to a number of steps at which the HP sensor 19 is supposed to be turned off or on when the light source unit 6 is rotated in the opposite direction, in this case, in the counterclockwise direction, regardless of the position of the light source unit 6 for the pixel densities (resolution) of 300 dpi, 400 dpi, or 600 dpi. It is to be noted that, in the optical scanning device according to the illustrative embodiment, the pixel densities (resolution) can be set to 300 dpi, 400 dpi, or 600 dpi.

Therefore, in the case in which the stepping motor 12 rotates in the counterclockwise direction a certain number of times, in this case, the stepping motor rotates by M steps, but the HP detector 19 is not turned on, it is determined that there is a problem in the pitch adjustment device 17.

According to the present illustrative embodiment, after 135 steps from the home position, the stepping motor 12 is supposed to be at a position corresponding to the pixel density of 300 dpi. After 150 steps, the stepping motor 12 is supposed to be at a position corresponding to the pixel density of 600 dpi. Thus, a maximum rotation position of the light source unit 6 is 150 steps at 600 dpi.

However, variation in parts placement can cause the position to vary. Accordingly, M step is set to "150+$\alpha$" so as to provide some margin of error in the value.

When the HP detector 19 detects the filler 15, the HP detector is in an ON state (HP detector: ON). When the HP detector 19 does not detect the filler 15, the HP detector is in an OFF state (HP detector: OFF).

Referring to FIG. 5, a position indicated by "FAILURE 1" in FIG. 5 refers to a position of the light source unit 6 when the HP detector 19 does not operate properly. A position indicated by "FAILURE 2" refers to a position of the light source unit 6 when the light source unit 6 does not follow the movement of the pressure member 14.

Figure 10:
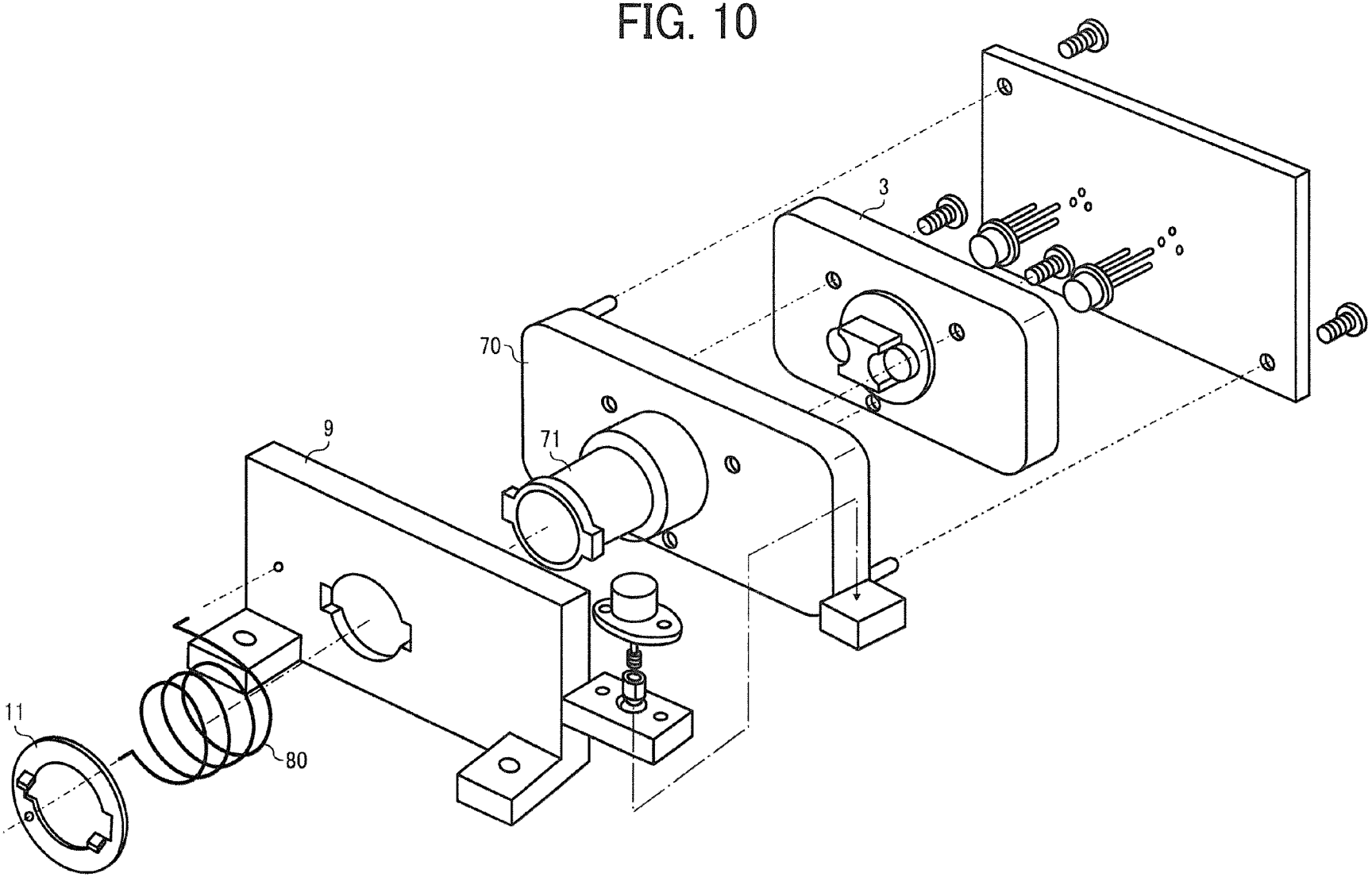
FIG. 10 is an exploded perspective view of a comparative example of a light source unit and a beam pitch adjustment mechanism.
Figure 11:
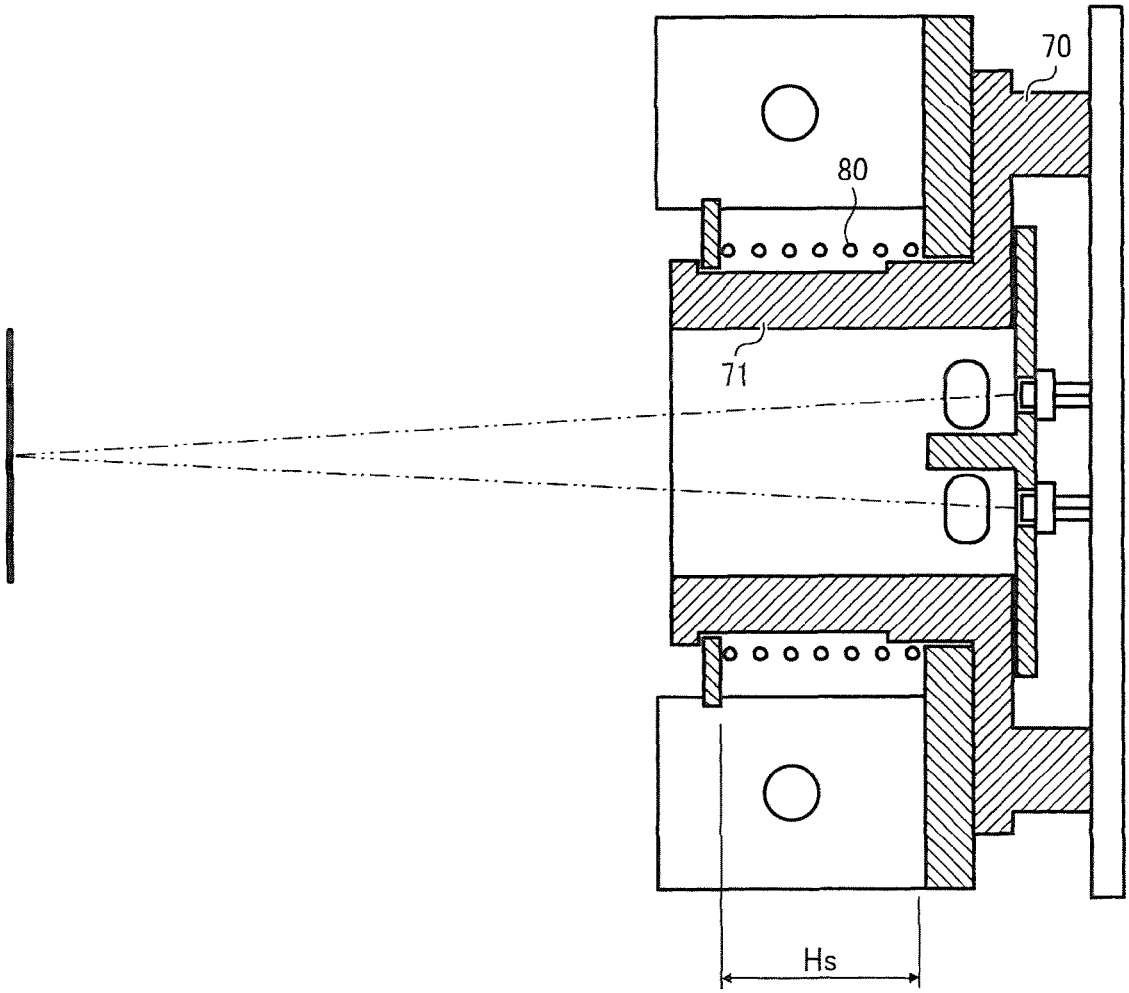
FIG. 11 is a cross-sectional view of FIG. 10 in a main scan direction.

Referring now to FIGS. 10 and 11, a description is provided of a comparative example of a light source unit and a beam pitch adjustment mechanism.

FIG. 10 is an exploded perspective view of the comparative example of the light source unit and the beam pitch adjustment mechanism. FIG. 11 is a cross-sectional view of FIG. 10 in the main scan direction.

As illustrated in FIGS. 10 and 11, a known coil spring 80 is used as both the urging mechanism that urges a retainer 70 in the optical axis direction and the inverse rotation urging mechanism that generates a torsional force in the opposite direction (counterclockwise direction).

The coil spring 80 is a known coil spring, that is, a coil spring that is not conical in contrast to the conical coil spring 10 according to the illustrative embodiment of the present invention.

The diameter of each ring of the coil spring 80 is the same, and a gap between each coil is relatively large. Consequently, as illustrated in FIG. 11, in order to accommodate the coil spring 80, a height Hs of a cylindrical protrusion 71 of the retainer 70 in the optical axis direction needs to be relatively high.

Furthermore, the light source unit and the beam pitch adjustment mechanism are integrated together in the optical scanning device.

In addition, a control board that drives semiconductor lasers, connectors, harnesses, and so forth are provided substantially at the back of the light source so that the size of the optical scanning device as a whole in the optical axis direction increases significantly, thereby reducing flexibility in the arrangement of parts in the multi-beam scanning device.

By contrast, according to the illustrative embodiment as illustrated in FIGS. 2 and 3, the conical-shaped compression-torsion coil spring 10 is employed as both the urging mechanism that urges the retainer 7 in the optical axis direction as well as the inverse rotation urging mechanism that generates the torsional force in the counterclockwise direction.

As described above, the coil spring 10 is a compression-torsion coil spring having a conical shape. When the conical coil spring 10 is compressed and mounted as illustrated in FIG. 3, the conical coil spring 10 is in a substantially spiral shape and attains the similar, if not the same urging force (in the optical axis direction) as that of the generally-known coil spring.

Furthermore, with this configuration, it is not necessary to take a closed height of each of the rings of the coil spring into consideration, thereby achieving a relatively small height H illustrated in FIG. 3. Consequently, the height of the cylindrical protrusion 700 of the retainer 7 can be reduced as well.

As a result, the size of the beam pitch adjustment mechanism in the optical axis direction can be reduced, thereby enabling the optical scanning device as a whole to be made compact.

When adjusting the beam pitch of the optical scanning device 6, because the control board to control laser elements, harnesses, and so forth are all connected to the light source unit 6, those components need to be rotated as well.

In order to assure rotation of those components and thus facilitate rotation of the light source unit 6 around the optical axis, that is, in the counterclockwise direction according to the illustrative embodiment, the torque of the coil spring 10 needs to overcome frictional resistance between the retainer 7 and the light source retainer 9, and resilience of the harness.

In addition, in view of changes in environment and fluctuation in the resilience of the harness, it is necessary to exert a relatively large torque on the coil spring 10. Consequently, relatively large stress is applied to the driving source that drives the pitch adjustment device 17, in this case, the stepping motor 12, thereby necessitating the stepping motor with greater torque, and the pressure member 14 having greater strength and durability.

In addition, depending on arrangement of the harness, the harness may cause significant resistance during rotation or during adjustment of the beam pitch, thereby preventing desirable rotation of the light source unit and causing failure in operation.

In view of the above, according to the illustrative embodiment, the pressure member 14 is formed of magnetic material such as iron. As illustrated in FIG. 4, a magnet 24 is provided to a portion of the extended portion 7*c* of the retainer 7 where the pressure member 14 contacts.

Accordingly, when the light source unit 6 rotates in the counterclockwise direction indicated by arrow CCW in FIG. 4, magnetic force enables the light source unit 6 to move upward following the pressure member 14, thereby reducing torque or the urging force of the coil spring 10 in the direction of rotation and thus resulting in reduction of cost of the stepping motor 12 and the pressure member 14.

With this configuration, when the pressure member 14 moves upward, the light source unit 6 can be reliably rotated, enhancing reliability of beam pitch adjustment.

Alternatively, instead of providing the magnet 24, the portion of the extended portion 7*c* that contacts the pressure member 14 may itself be magnetic.

Next, a description is provided of control of the beam pitch adjustment. In the optical scanning device, when the resistance of the light source unit 6 varies during rotation or when the harness is accidentally caught preventing the rotation of the light source unit 6, beam pitch adjustment of the light source unit 6 cannot be properly performed, resulting in operation failure.

Furthermore, when the HP detector has a problem or fails due to deterioration over time, the beam pitch adjustment may not be properly performed as well.

When such failure occurs, the light source unit 6 stops before reaching the home position or after passing the home position, resulting in erroneous beam pitch on the scan surface and thus resulting in significant deterioration in quality of an image.

Generally, when an error occurs, the image forming apparatus obtains information of the error from the beam pitch error detector 22, turns on a maintenance signal that requests a user to call maintenance personnel, and halts the operation.

In such a case, conventionally, the user is not able to use the image forming apparatus until the maintenance personnel finishes maintenance. As a result, productivity is significantly reduced.

In view of the above, in order to prevent reduction in productivity, the optical scanning apparatus 50 according to the illustrative embodiment employs the following beam pitch adjustment control.

Embodiment 1

According to one illustrative embodiment, when the beam pitch adjustment fails, the stepping motor 12 is rotated in a reverse direction by the same number of steps as the number of steps by which the stepping motor 12 was rotated in the counterclockwise direction, that is, the number of steps rotated for beam pitch adjustment, so that the rotation angle of the light source unit 6 is returned to its original position, and subsequent beam pitch adjustment is inhibited. This is referred to as "Pitch Fixing Mode".

With this configuration, the beam pitch is set to a preset fixed pitch, for example 42.3 μm, for a pixel density of 600 dpi and 63.5 μm for 400 dpi. At these ranges, visible image degradation (visible by human eyes) is not found in an output image.

Accordingly, image forming operation can be performed continuously in this state until the maintenance personnel completes maintenance, thereby preventing reduction in the productivity.

Figure 6:
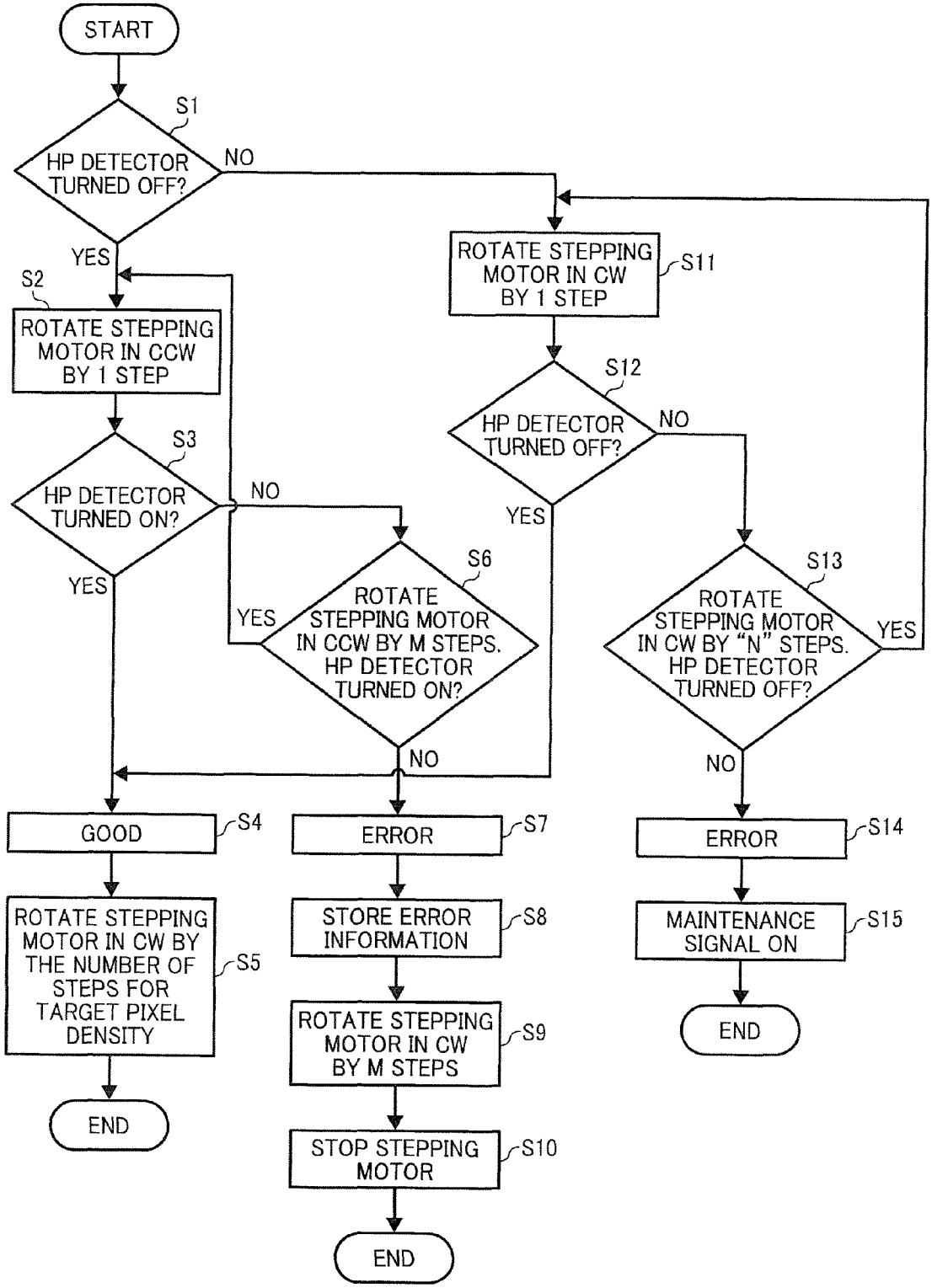
FIG. 6 is a flowchart showing beam pitch adjustment control procedure according to an illustrative embodiment of the present invention.

With reference to FIGS. 4 through 6, a detailed description of the beam pitch adjustment control is provided. FIG. 6 is a flowchart showing an example procedure of the beam pitch adjustment control according to the embodiment 1.

In FIG. 6, when the beam pitch adjustment control is initiated, whether or not the HP detector 19 is OFF is determined at S1. When the HP detector 19 is OFF (Yes at S1), the stepping motor 12 is rotated in the counterclockwise (CCW) direction by 1 step at S2.

By contrast, when the HP detector 19 is ON at S1 (No at S1), the stepping motor 12 is rotated in the clockwise direction by 1 step at S1.

When the stepping motor 12 is rotated in the counterclockwise direction and the HP detector 19 is turned on (Yes at S3), and when the stepping motor 12 is rotated in the clockwise direction and the HP detector 19 is tuned off (Yes at S12), the operation is determined as "GOOD" at S4.

Subsequently, at S5, the stepping motor 12 is rotated in the clockwise direction by the number of steps for the beam pitch of a target pixel density.

With this configuration, when the user designates 600 dpi as a desired pixel density (resolution) in the image forming apparatus, for example, the light source unit 6 can be properly rotated so as to achieve the beam pitch corresponding to 600 dpi at a normal mode (Normal Mode).

By contrast, when the HP detector 19 is not turned on at S3 (No at S3), the stepping motor 12 is rotated in the counterclockwise direction by M steps at S6 as previously described with reference to FIG. 5.

After the stepping motor 12 is rotated by M steps, but the HP detector 19 is not turned on at S6 (NO at S6), it is determined as "ERROR" at S7. Subsequently, at S8, information of the error that turns on the maintenance signal that informs the user to call maintenance personnel is stored.

Furthermore, at S9, the stepping motor 12 is rotated in the clockwise (CW) direction by M steps, and then, at S10, the stepping motor 12 is halted.

Accordingly, the light source unit 6 is fixed at a certain beam pitch position corresponding to the predetermined rotation angle and is able to resume writing. This is referred to as a "pitch fixing mode".

When the HP detector 19 is not tuned off at S12 (No at S12), the stepping motor 12 is further rotated in the clockwise direction by an "N" step(s) at S13. "N" refers to a predetermined number.

However, even if the stepping motor 12 is rotated in the clockwise direction by the predetermined "N" step(s), but the HP detector 19 is not turned off (No at S13), it is determined as "ERROR" at S14. Subsequently, the maintenance signal is turned on at S15.

In this case, when the light source unit 6 is rotated in the clockwise direction while the HP detector 19 is on, that is, the light source unit 6 is at the home position, the HP detector 19 is not turned off. This means that there is something that prevents the light source unit 6 from rotating, in particular, rotating in the clockwise direction.

Therefore, the light source unit 6 cannot travel from the home position to any of the positions for 300, 400, and 600 dpi (refer to FIG. 5), and thus the maintenance signal for requesting the maintenance personnel is turned on immediately.

Table 1 shows a relation of the direction of rotation of the stepping motor 12, the direction of travel of the pressure member 14, and the direction of rotation of the light source unit 6.

TABLE 1

| Stepping Motor Direction of Rotation | Pressure Member Direction of Travel | Light Source Unit Direction of Rotation |
|---|---|---|
| Clockwise Direction | Downward | Clockwise Direction |
| Counterclockwise Direction | Upward | Counterclockwise Direction |

As can be seen in Table 1, when the stepping motor 12 is rotated in the clockwise (CW) direction, the pressure member 14 moves downward and the light source unit 6 is rotated in the clockwise direction.

By contrast, when the stepping motor 12 is rotated in the counterclockwise (CCW) direction, the pressure member 14 moves upward and the light source unit 6 is rotated in the counterclockwise direction, as illustrated in FIG. 4.

Embodiment 2

Next, a description is provided of a variation of the foregoing embodiment. According to the present embodiment, when the beam pitch adjustment fails, the number of steps for achieving the preset pixel density that the user set is calculated based on the number of steps by which the stepping motor 12 was rotated in the counterclockwise direction and the pixel density that was set prior to the failure in the pitch adjustment.

Subsequently, the stepping motor 12 is rotated in the clockwise direction by the number of steps being calculated so as to adjust the beam pitch to the beam pitch of the preset pixel density, and the subsequent beam pitch adjustment is inhibited.

According to the present embodiment, the most frequently-used pixel density is set as a preset pixel density that the user sets so that writing can be performed at the frequently-used beam pitch regardless of failure in the pitch adjustment or operation failure. Accordingly, degradation in imaging quality can be reduced or significant degradation can be prevented.

Furthermore, with this configuration, while maintenance personnel performs maintenance on the image forming apparatus, the image can still be output at the most frequently-used beam pitch, thereby preventing reduction in productivity.

Figure 7:
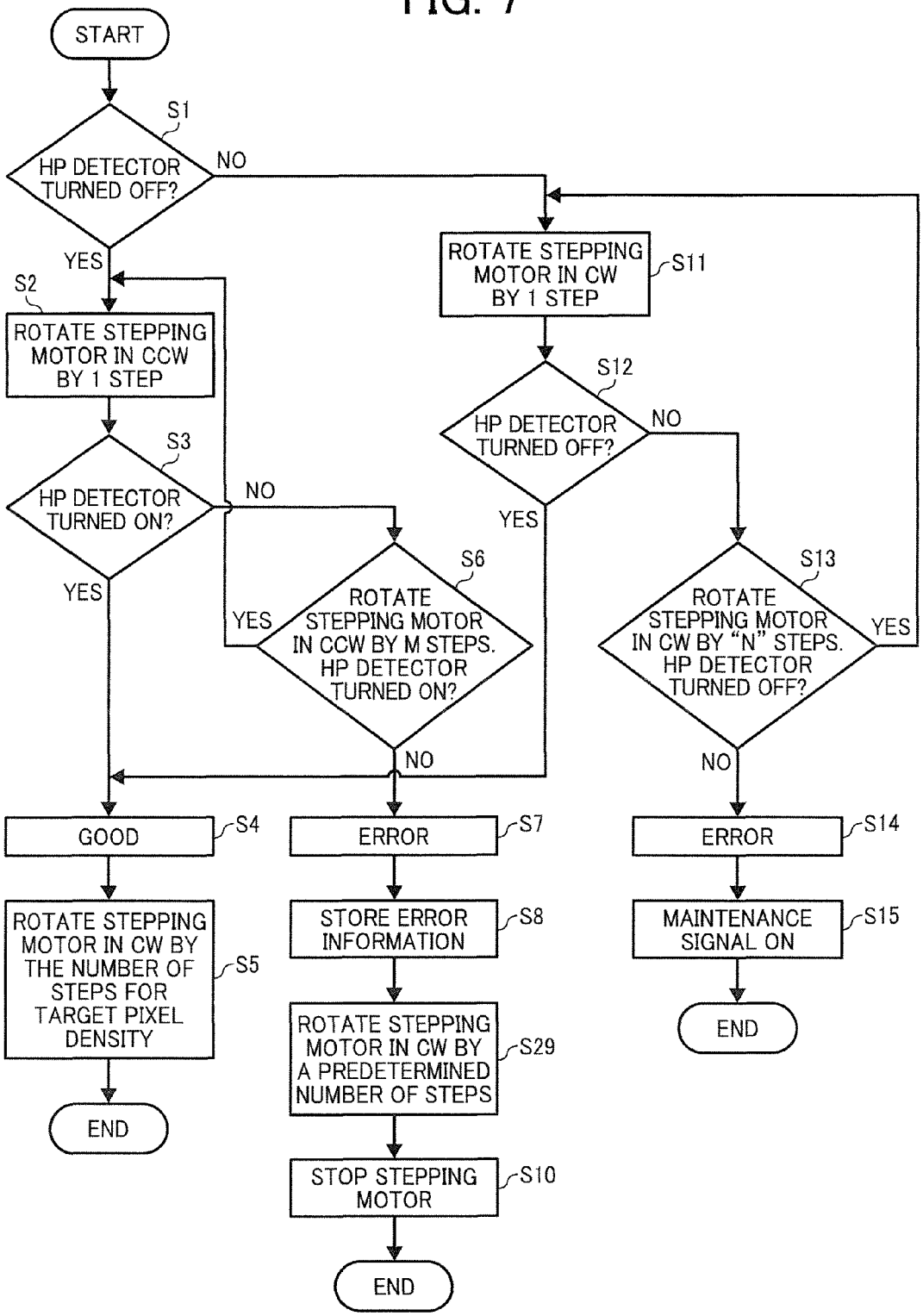
FIG. 7 is a flowchart showing beam pitch adjustment control procedure according to another illustrative embodiment of the present invention.

With reference to FIGS. 4 through 7, a detailed description of the beam pitch adjustment control according to the present embodiment is provided. FIG. 7 is a flowchart showing an example procedure of the beam pitch adjustment control which is the same as that shown in FIG. 6, except for S29.

Therefore, the same reference numbers as that of FIG. 6 are provided to the same steps in FIG. 7, except for S29. The description is herein only provided to the different process as compared to the procedure in FIG. 6.

When it is determined as "ERROR" at S7, the error information that turns on the maintenance signal is stored at S8. Subsequently, at S29, the stepping motor 12 is rotated in the clockwise direction by a predetermined number of steps. This differs from the procedure shown in FIG. 6.

The predetermined number of steps herein refers to a value obtained by the following equation 1.

$$\text{The predetermined number of steps} = M \text{ steps} - [(\text{Number of steps for setting the present pixel density}) - (\text{Number of steps for the target pixel density})] \quad (1)$$

For example, when the value of M steps is 155, the number of steps for setting the present pixel density is 140 (400 dpi) and the number of steps for achieving the target pixel density is 135 (300 dpi), the predetermined number of steps is:

$$155-\{(140-135)\}=150$$

In this example, when the stepping motor 12 is rotated in the clockwise (CW) direction by the predetermined number of steps, that is, 150 steps, at S29, writing is performed while the beam pitch is fixed to 300 dpi in the pitch fixing mode.

Embodiment 3

Next, a description is provided of beam pitch adjustment control of a variation of the foregoing embodiments. According to the present embodiment, when the beam pitch adjustment fails and the light source unit 6 is returned to the position prior to the failure, this position, that is, the position prior to the adjustment failure, is set as a tentative home position (HP) thereafter.

Subsequently, the light source unit 6 is rotated by an amount of difference between the tentative home position and the position of the light source unit 6 for the target pixel density.

For example, when the pixel density prior to the adjustment failure was 600 dpi, in other words, when the light source unit 6 was positioned at a position corresponding to the pixel density of 600 dpi, this position is a position after 150 steps rotated from the original home position in the clockwise direction.

When it is desired that the beam pitch be adjusted to 400 dpi, the light source unit 6 is rotated in the counterclockwise (CCW) direction by 10 steps (150−140=10) from the tentative home position, that is, the position after 150 steps from the original home position.

With this configuration, even if there may be some shift from the target beam pitch, the amount of the shift will be insignificant so that it is possible to comfortably continue image forming operation until the maintenance personnel completes maintenance, thereby preventing reduction in productivity.

With reference to FIGS. 4 through 8, a detailed description of the beam pitch adjustment control according to the present embodiment is provided.

Figure 8:
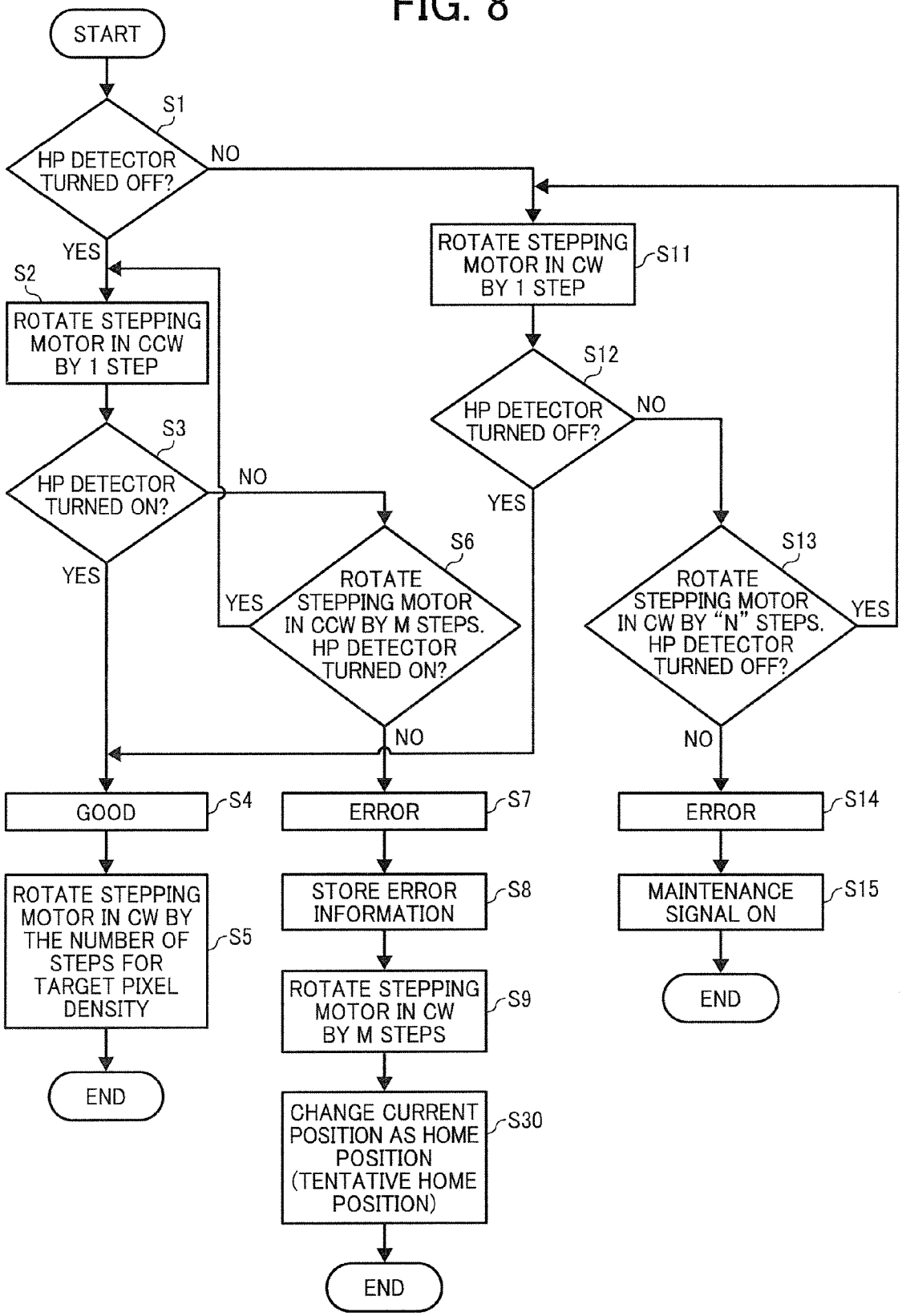
FIG. 8 is a flowchart showing beam pitch adjustment control procedure according to still another illustrative embodiment of the present invention.

FIG. 8 is a flowchart showing an example procedure of the beam pitch adjustment control which is the same as the flowchart shown in FIG. 6, except for S30. Therefore, the same reference numbers as that of FIG. 6 are provided to the same steps in FIG. 8, except for S30.

The description is herein only provided to the different procedure as compared to the procedure in FIG. 6.

When it is determined as "ERROR" at S7, the error information that turns on the maintenance signal is stored at S8.

Subsequently, at S9, the stepping motor 12 is rotated in the clockwise direction by M steps, and this position is set as a home position (tentative home position) at S30 to perform subsequent control. This procedure is referred to as "HP position change mode".

Figure 9:
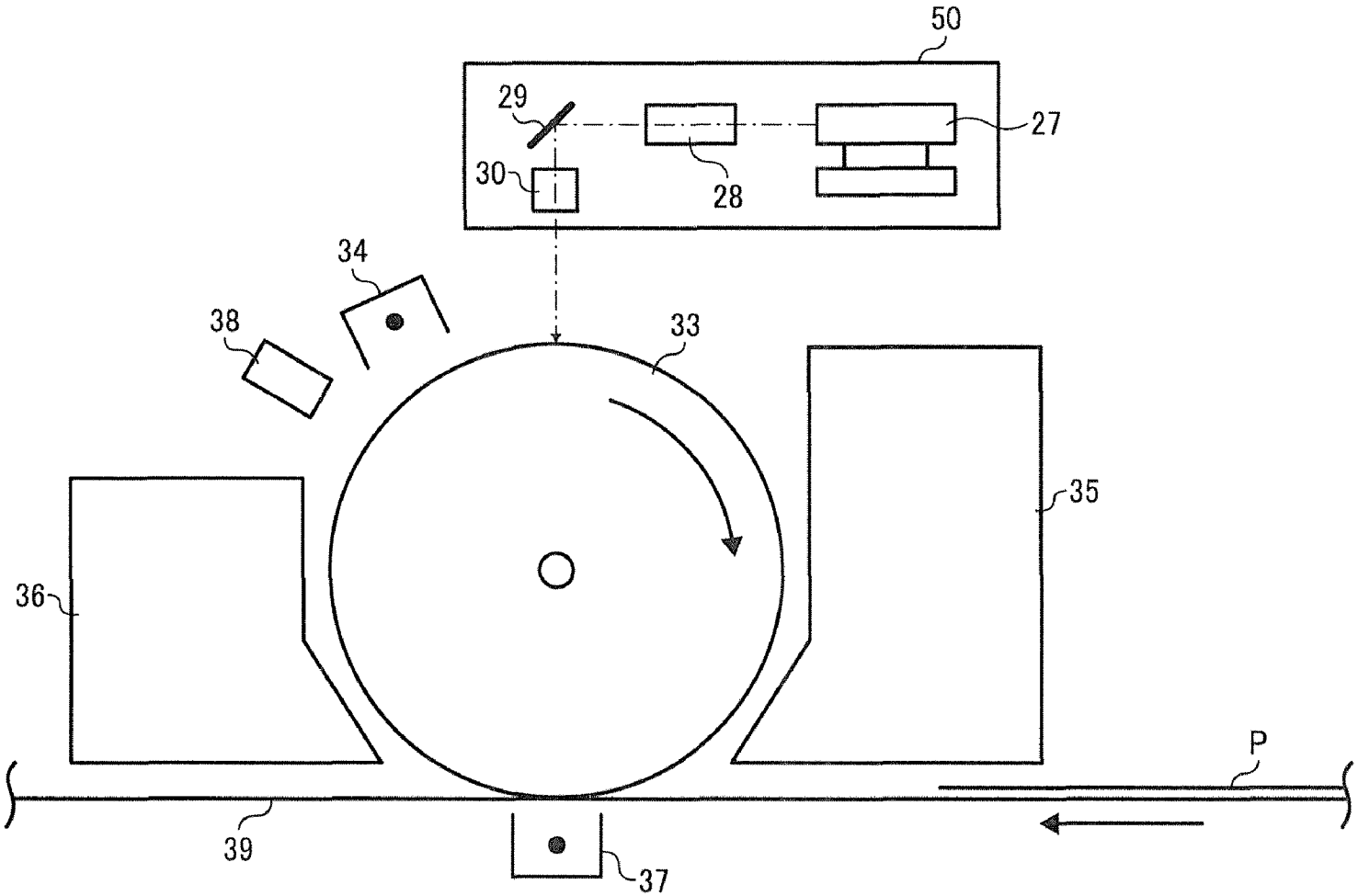
FIG. 9 is a schematic diagram illustrating a configuration around an image forming portion of an image forming apparatus including the optical scanning device according to an illustrative embodiment of the present invention.

Referring now to FIG. 9, there is provided a schematic diagram illustrating a configuration around an image forming portion of an image forming apparatus including the optical scanning device according to the illustrative embodiment of the present invention.

FIG. 9 illustrates the image forming portion employed in a monochrome image forming apparatus. In FIG. 9, the image forming apparatus includes the photoreceptor drum 33 serving as an image bearing member, a charging device 34, a developing device 35, a cleaning device 36, a transfer device 37, a charge neutralizer 38, and so forth.

Substantially above these components, an optical scanning device 50 is provided. The optical scanning device 50 is the same as that shown in FIG. 1. As illustrated in FIG. 9, the optical scanning device 50 includes the polygon mirror 27, the f-θ lens 28, the reflective mirror 29, and the toroidal lens 30.

Although not illustrated in FIG. 9, similar to FIG. 1, the optical scanning device 50 includes the first and the second semiconductor lasers constituting the multi-beam light source unit 6, a composite prism, and so forth.

In the monochrome image forming apparatus according to the illustrative embodiment, the charging device 34 evenly charges the surface of the photoreceptor drum 33.

In the optical scanning device 50, the laser diode (LD) is driven in accordance with image data transmitted from a host machine, such as a personal computer (PC), so as to illuminate the polygon mirror 27 with laser beams. The reflected light is directed onto the photoreceptor drum 33 through the cylinder lens or the like, thereby forming an electrostatic latent image on the photoreceptor drum 33.

The developing device 35 develops the electrostatic latent image with toner, thereby forming a toner image, that is, a visible image, on the surface of the photoreceptor drum 33.

A description is now provided of sheet feeding operation. A recording medium P is fed from a sheet feeder, not illustrated, and sent out by registration rollers, also not illustrated, in appropriate timing such that the recording medium P is aligned with the toner image formed on the photoreceptor drum 33.

The recording medium P is borne on a transfer belt 39 and transported to a transfer position where the photoreceptor drum 33 faces a transfer device 37.

At the transfer position, the toner image on the photoreceptor drum 33 is transferred onto the recording medium P and then transported to a fixing device, not illustrated. In the fixing device, the toner image that is not yet fixed is fixed onto the recording medium P and then discharged outside.

After the toner image is transferred from the photoreceptor drum 33 onto the recording sheet P, residual potential is removed from the photoreceptor drum 33 by the charge neutralizer 38 in preparation for the subsequent imaging cycle.

Although not illustrated, a control panel of the image forming apparatus allows the user to set the resolution (the pixel density).

The beam pitch error detector 22 illustrated in FIG. 5 can be included in the control unit of the image forming apparatus.

The foregoing description pertains to the optical scanning device and the image forming apparatus including the optical scanning device according to the illustrative embodiments. However, the present invention is not limited to the specifically disclosed embodiments.

For example, the present invention can be applied to a multi-beam scanning device using three beams or more.

The direction of rotation of the light source unit described above is one example. Alternatively, the light source unit can be rotated in an opposite direction of that described above to adjust the beam pitch.

Furthermore, the resolution is not limited to the resolutions described above. The number of steps necessitated for moving the light source unit from the home position to an appropriate angle for the desired resolution described above is one example. The number of steps can be modified.

The stepping motor is employed for driving the light source unit according to the illustrative embodiment. However, the device for driving the light source unit is not limited to a stepping motor, but any other suitable motors or driving devices can be employed.

The foregoing description pertains to a monochrome image forming apparatus as one example of an image forming apparatus. However, the present invention can be employed in a full-color image forming apparatus or a color image forming apparatus using two to three colors.

The image forming apparatus includes, but is not limited to, a copier, a printer, a facsimile machine, and a multi-functional system including any combination thereof.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A multi-beam scanning device for focusing deflected light beams onto an object to be scanned, comprising:

a light source unit rotatable about an optical axis, the light source unit including a plurality of light sources configured to emit light beams and a plurality of coupling lenses disposed corresponding to the light sources;

a deflector configured to deflect the light beams emitted from the plurality of the light sources and passed through the plurality of the coupling lenses;

a pitch adjustment device configured to move the light source unit in a first direction around the optical axis to adjust a beam pitch;

a conical-shape compression-torsion coil spring configured to urge the light source unit in a second direction opposite the first direction around the optical axis as well as in the optical axis direction; and an error detector configured to detect an error in beam pitch adjustment performed by the pitch adjustment device, wherein, when the error detector detects the error in the beam pitch adjustment, the light source unit is returned to a position prior to detection of the error and inhibits subsequent beam pitch adjustment.

2. A multi-beam scanning device for focusing deflected light beams onto an object to be scanned, comprising:

a light source unit rotatable about an optical axis, the light source unit including a plurality of light sources configured to emit light beams and a plurality of coupling lenses disposed corresponding to the light sources;

a deflector configured to deflect the light beams emitted from the plurality of the light sources and passed through the plurality of the coupling lenses;

a pitch adjustment device configured to move the light source unit in a first direction around the optical axis to adjust a beam pitch;

a conical-shape compression-torsion coil spring configured to urge the light source unit in a second direction opposite the first direction around the optical axis as well as in the optical axis direction, wherein the pitch adjustment device includes a pressure member made of magnetic material configured to contact and press against the light source unit, and magnetic force is applied to a contact area of the light source unit where the pressure member contacts the light source unit.

3. A multi-beam scanning device for focusing deflected light beams onto an object to be scanned, comprising:

a light source unit rotatable about an optical axis, the light source unit including a plurality of light sources configured to emit light beams and a plurality of coupling lenses disposed corresponding to the light sources;

a deflector configured to deflect the light beams emitted from the plurality of the light sources and passed through the plurality of the coupling lenses;

a pitch adjustment device configured to move the light source unit in a first direction around the optical axis to adjust a beam pitch;

a conical-shape compression-torsion coil spring configured to urge the light source unit in a second direction opposite the first direction around the optical axis as well as in the optical axis direction; and an error detector configured to detect an error in beam pitch adjustment performed by the pith adjustment device, wherein when the error detector detects the error in the beam pitch adjustment, the light source unit is moved to a predetermined position.

4. The multi-beam scanning device according to claim 3, wherein when the error detector detects the error in the beam pitch adjustment, the light source unit is moved to a position corresponding to the beam pitch of a predetermined pixel density and inhibits subsequent beam pitch adjustment.

5. The multi-beam scanning device according to claim 3, wherein when the error detector detects the error in the beam pitch adjustment, a position prior to detection of the error is set as a tentative home position and subsequent beam pitch adjustment is performed.

6. The multi-beam scanning device according to claim 5, wherein after the tentative home position is set, the beam pitch is adjusted by rotating the light source unit by an amount corresponding to a distance between the tentative home position and a position corresponding to a target pixel density.

7. The image forming apparatus according to claim 3, wherein the pitch adjustment device includes a pressure member made of magnetic material configured to contact and press against the light source unit, and magnetic force is applied to a contact area of the light source unit where the pressure member contacts the light source unit.

8. An image forming apparatus for forming an image, comprising:

an image bearing member configured to bear an electrostatic latent image on a surface thereof;

a charging device configured to charge the surface of the image bearing member;

a developing device configured to develop the electrostatic latent image using toner to form a toner image;

a transfer device configured to transfer the toner image onto a recording medium;

a fixing device configured to fix the toner image onto the recording medium; and a multi-beam scanning device configured to focus deflected light beams onto an object to be scanned, the multi-beam scanning device including:

a light source unit rotatable about an optical axis, the light source unit including a plurality of light sources configured to irradiate light beams and a plurality of coupling lenses disposed corresponding to the light sources;

a deflector configured to deflect the light beams irradiated from the plurality of the light sources and passed through the plurality of the coupling lenses;

a pitch adjustment device configured to move the light source unit in a first direction around the optical axis to adjust a beam pitch;

a conical-shape compression-torsion coil spring configured to urge the light source unit in a second direction opposite the first direction around the optical axis as well as in the optical axis direction; and an error detector configured to detect an error in beam pitch adjustment performed by the pitch adjustment device, wherein, when the error detector detects the error in the beam pitch adjustment, the light source unit is returned to a position prior to detection of the error and inhibits subsequent beam pitch adjustment.

* * * * *